United States Patent [19]

Böckenhoff et al.

[11] 4,011,110

[45] Mar. 8, 1977

[54] METHOD AND APPARATUS FOR FORMING AND TREATING BUNDLES OF STEEL RODS

[75] Inventors: Hermann-Josef Böckenhoff, Blecher; Walter Schaeffer, Cologne; Berthold Kranz, Duren, all of Germany

[73] Assignee: Arbed-F & G Drahtwerke Koln GmbH, Cologne, Germany

[22] Filed: July 24, 1975

[21] Appl. No.: 598,667

[30] Foreign Application Priority Data

July 25, 1974 Germany ..... 2435830

[52] U.S. Cl. ..... 148/12 B; 148/15; 148/153; 266/107; 266/120

[51] Int. Cl.[2] ..... C21D 1/64; C21D 9/58

[58] Field of Search ..... 148/12 B, 12.4, 15, 148/153, 14, 11.5 R; 266/4 A

[56] References Cited

UNITED STATES PATENTS

| | | | |
|---|---|---|---|
| 1,984,744 | 12/1934 | Hood | 242/79 |
| 2,023,736 | 12/1935 | Lloyd | 148/12.4 |

FOREIGN PATENTS OR APPLICATIONS

| | | | |
|---|---|---|---|
| 1,158,942 | 7/1969 | United Kingdom | 148/14 |
| 1,048,833 | 11/1966 | United Kingdom | 148/14 |

*Primary Examiner*—W. Stallard
*Attorney, Agent, or Firm*—Michael J. Striker

[57] ABSTRACT

A hot steel rod which issues from the last pass of a rod mill is coiled at a level above a bath of molten salt and successive coils are caused to descend in the bath toward a platform on which they accumulate to form a bundle. The coils are out of contact with each other during the initial stage of movement toward the platform for a period of time which is long enough to insure that their material undergoes desirable structural changes. The temperature of the bath is maintained within a predetermined range by an adjustable induction heater which surrounds the vessel for the bath and by circulating a stream of molten salt through one or more heat exchangers located outside of the vessel. The stream is withdrawn close to the bottom zone and is returned into the upper zone of the bath. Alternatively, the vessel may contain a mammoth pump which is operated by water and steam. The steam withdraws a stream of molten salt from the vessel and is thereupon separated from withdrawn molten salt before the latter is returned into the bath. The separated steam is condensed and is used to rinse bundles (after the bundles are removed from the bath) prior to readmission into the mammoth pump. The bundles are thereupon caused to pass through a wire die.

17 Claims, 2 Drawing Figures

METHOD AND APPARATUS FOR FORMING AND TREATING BUNDLES OF STEEL RODS

BACKGROUND OF THE INVENTION

The present invention relates to the manufacture of wire in general, and more particularly to improvements in a method and apparatus for forming and treating metallic rods, preferably steel rods, prior to drawing through a wire die.

It is known to treat a steel rod which issues from the last pass of a rod mill, and whose temperature is in the range of approximately 1000° C., with a view to effect desirable structural changes in the material of the rod before the latter is introduced into a wire die. The treatment may involve abruptly cooling the rod immediately behind the last pass of the rod mill so that the temperature of the rod drops below the $Ac_3$ point. The cooling may be carried out by causing the rod to exchange heat with water and/or air, fluidized heat carriers or molten suspensions or solutions of salts or the like. One of the presently known heat exchanging agents is sodium nitrate.

A drawback of presently known methods and apparatus (including those using sodium nitrate) for treating steel rods prior to drawing in a wire die or the like is that they cannot be used on a large scale for mass-production of steel wire. The main reason is believed to be that it was not possible to maintain the temperature of the cooling or heat exchanging medium within a sufficiently narrow range to insure uniform withdrawal of heat from each and every increment of the rod. Such uniform withdrawal of heat is necessary in order to insure that each portion of the rod undergoes an optimum structural change prior to introduction into the wire die. The difficulties in connection with the establishment and maintenance of an optimum temperature range for the coolant are attributed to the fact that the speed of the rod which issues from the mill is likely to vary, that the rod introduces into the coolant very large amounts of heat energy, and that the maintenance of a predetermined temperature range may involve cooling and/or heating the coolant as well as insuring that each and every zone or portion of the coolant is maintained at the same temperature. Additional problems arise during starting of conventional apparatus because the heating of coolant to a desirable optimum temperature to effect satisfactory structural changes in the material of the rod takes up too much time. As a rule, the rod which issues from the mill is spread out fanwise by the transporting means or is converted into a bundle of abutting coils prior to introduction into the cooling medium. The coiling or winding of the rod takes place in a vessel which contains the cooling medium, or the bundle is formed prior to introduction into the vessel. In each instance (i.e., during spreading or during coiling), neighboring portions of the rod contact each other so that they are not cooled to the same extent as those portions which are in direct contact with the coolant. The result is a non-uniform treatment, i.e., structural changes in those portions of the rod which are in direct contact with each other are often basically different from those taking place in rod portions which are in direct contact with the coolant, such as molten sodium nitrate. This affects the quality of the ultimate product and presents problems during drawing through the die.

SUMMARY OF THE INVENTION

An object of the invention is to provide a novel and improved method of converting metallic rods into bundles, particularly for converting hot steel rods into bundles which are ready for drawing through a wire die.

Another object of the invention is to provide a method which insures that each and every portion of each coil of a bundle undergoes identical structural changes during conversion of the rod into coils and during subsequent or simultaneous conversion of coils into a bundle.

A further object of the invention is to provide a method which insures that the conversion of hot steel rods into bundles results in the formation of relatively small quantities of scale.

An additional object of the invention is to provide a novel and improved method of conditioning the liquid bath wherein a hot steel rod is treated prior and/or during conversion into a bundle.

Still another object of the invention is to provide a novel and improved apparatus for the practice of the above outlined method.

Another object of the invention is to provide an apparatus which insures that each and every portion of each of a series of bundles of metallic rod stock has undergone identical structural changes during treatment in a liquid bath.

An ancillary object of the invention is to provide the apparatus with novel and improved means for conditioning the liquid bath.

A further object of the invention is to provide the apparatus with novel and improved means for maintaining the temperature of the liquid bath within a range which is much narrower than that which can be achieved in conventional apparatus.

Another object of the invention is to provide an apparatus which is more economical than heretofore known apparatus and whose output of satisfactory material is higher than that of presently used apparatus for conversion of hot steel rods into bundles.

One feature of the invention resides in the provision of a method of forming and treating bundles of metallic rods, particularly hot steel rods which issue from the last pass of a rod mill and are prepared for drawing through a wire die. The method comprises the steps of moving a hot metallic rod lengthwise (e.g., by means of the rolls in the last pass of the mill), winding the leader of the rod to form a succession of coils at a level above a confined bath of liquid (e.g., a molten salt bath), maintaining the temperature of liquid within a predetermined range which is practically invariably less than the temperature of the coils, allowing or causing successive coils to descend into the bath by gravity and maintaining neighboring coils out of contact with each other for a period of time which is sufficient to effect a predetermined structural change in the material of the coils as a result of the difference between the temperature of the coils and the liquid, and accumulating successive coils into a bundle of abutting coils or convolutions in the lower zone of the bath.

The step of maintaining the temperature of liquid within a predetermined range comprises continuously adding heat to and/or removing heat from the liquid of the bath. The heat removing step may comprise continuously withdrawing a stream of liquid from the bottom zone of the bath, cooling the withdrawn liquid stream, and returning the cooled liquid into the top zone of the bath. The step of maintaining the temperature of liquid within a predetermined range may further comprise exchanging heat between the bath and a body of water (which is thereby converted into steam), and the method may further comprise the steps of removing the bundle from the bath, rinsing the thus removed bundle with such water to remove salt from the convolutions, and reintroducing the thus removed salt into the bath (preferably in the course of the aforementioned conversion of water into steam).

The rod can be cooled prior to winding. Also, the rod can be contacted by an inert gas prior to winding in order to reduce the formation of scale.

The aforementioned predetermined temperature range for the bath is selected in dependency on the temperature of coils which descend into the bath toward the bundling station, on desired structural changes in the material of the coils, on the speed of lengthwise movement of the rod which issues from the mill, and on the minimum length of that portion of the path of coils which successive coils cover while descending from the upper surface of the bath onto and into contact with the preceding coils.

The novel features which are considered as characteristic of the invention are set forth in particular in the appended claims. The improved apparatus itself, however, both as to its construction and its mode of operation, together with additional features and advantages thereof, will be best understood upon perusal of the following detailed description of certain specific embodiments with reference to the accompanying drawing.

DESCRIPTION OF THE PREFERRED EMBODIMENTS

Figure 1:
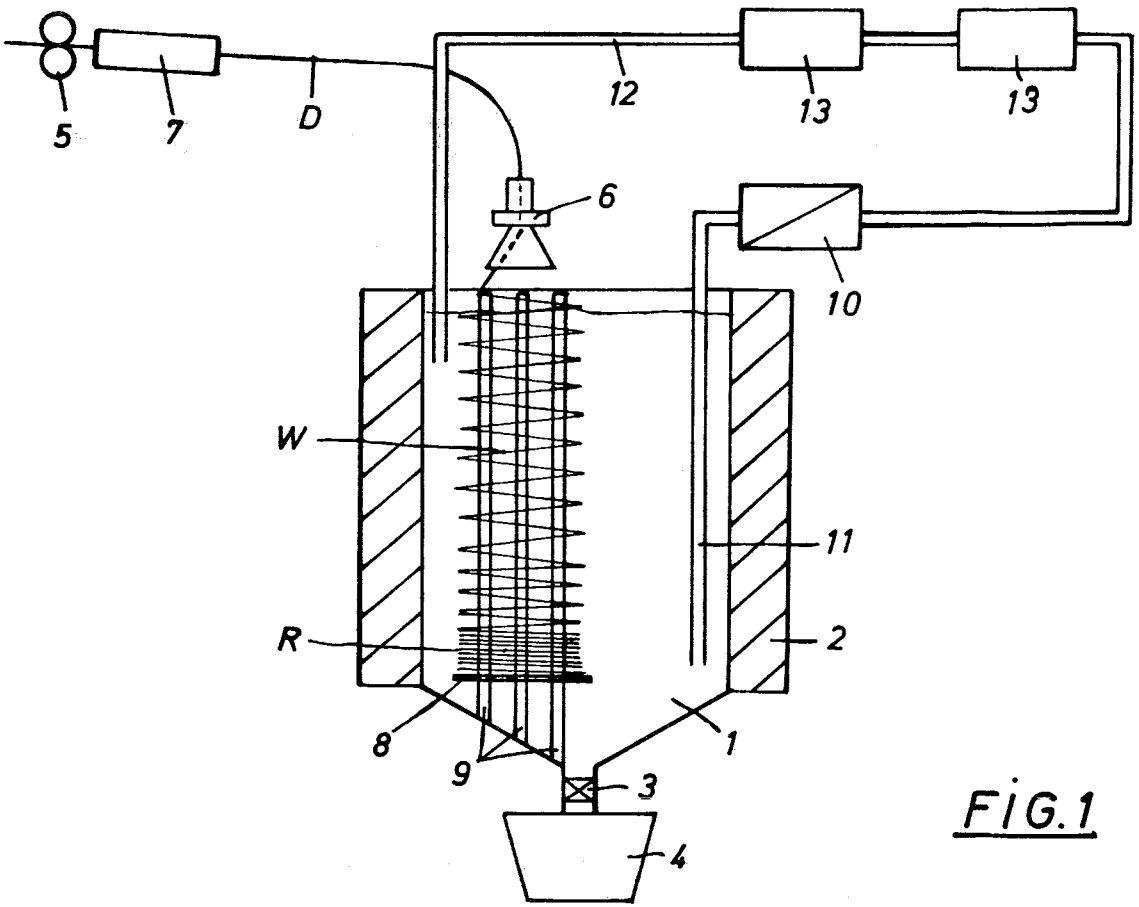
FIG. 1 is a diagrammatic partly elevational and partly sectional view of an apparatus which embodies one form of the invention.

The apparatus which is shown in FIG. 1 comprises a vessel 1 for a molten salt bath, e.g, sodium nitrate. The contents of the vessel 1 are or can be heated by a preferably adjustable induction type electric heater 2 which surrounds the cylindrical upper portion of the vessel. The lower portion of the vessel is conical and its deepmost part is provided with a normally closed gate 3 which can be opened at intervals to allow for transfer of accumulated scale and/or other solid impurities into a collecting receptacle 4.

The rod D which is to be converted into wire in a suitable die (not shown) issues from the last pass 5 of a rod mill and is caused to advance through a cooling unit 7 before it reaches a coiling or winding device 6 loacted above the open top of the vessel 1. The device 6 converts the rod D into a series of loose coils W which do not touch each other and surround an upright guide including a set of vertical rod-like members 9 mounted in the interior of the vessel 1. Successively formed coils W are located in substantially horizontal planes and do not touch each other upon entry into the body of molten salt in the vessel 1. The spacing of neighboring coils W in the upper part of the vessel 1 is substantially constant. The lowermost or foremost coil W comes to rest on a horizontal platform 8 which is mounted on the members 9 or in the conical lower portion of the vessel 1, and the next-following coils W descend onto the lowermost coil to form therewith a cylinder R (hereinafter called bundle) of abutting coils or convolutions. The weight of a fully assembled bundle R may be in the range of 300 to 1000 lbs. The temperature of the rod D issuing from the last pass 5 of the mill may be about 1000° C.

The liquid contents of the vessel 1 are recirculated by a pump 10 whose inlet is connected with a suction pipe 11 extending into or close to the lower portion of the vessel 1. The outlet of the pump 10 is connected with a return pipe 12 which discharges liquid into the upper portion of the vessel 1 and conveys the liquid through one or more heat exchangers 13. The apparatus of FIG. 1 includes two heat exchangers 13 which are connected in series. The outlet of the return pipe 12 is adjacent to the locus where the coils W descending from the winding device 6 enter the body of liquid in the vessel 1. The heat exchangers 13 withdraw from the liquid such quantities of heat which must be removed in order to insure that the temperature of the bath in the vessel 1 remains within a predetermined narrow range. In other words, the heat exchangers 13 remove all or nearly all such heat which is supplied to the bath by successive coils W of the rod D.

The length of intervals during which the coils W remain spaced apart from other (i.e., of the each interval which elapses while a coil W which has just entered the upper stratum or zone of the bath in the vessel 1 descends and ultimately contacts the uppermost convolution of the bundle R) is selected with a view to insure that the liquid in the vessel 1 has ample time to effect desirable structural changes in the material of such coils. Since the coils W are loose (they do not contact each other), the influence of liquid upon each coil is predictable. Structural changes taking place in successive increments of the rod D which travel from the last pass 5 of the rod mill toward the upper zone of the body of liquid in the vessel 1 are equally predictable for the same reason, i.e., because the coils or the corresponding increments of the rod cannot contact each other before they reach the uppermost convolution of the bundle R. Predictable changes in structure of successive convolutions of the bundle R are further insured due to the fact that the liquid which fills the vessel 1 is being recirculated so that its temperature in the interior of the vessel fluctuates very little or not at all. Consequently, the texture of the entire bundle R is uniform the foremost to the last or uppermost convolution thereof.

Figure 2:
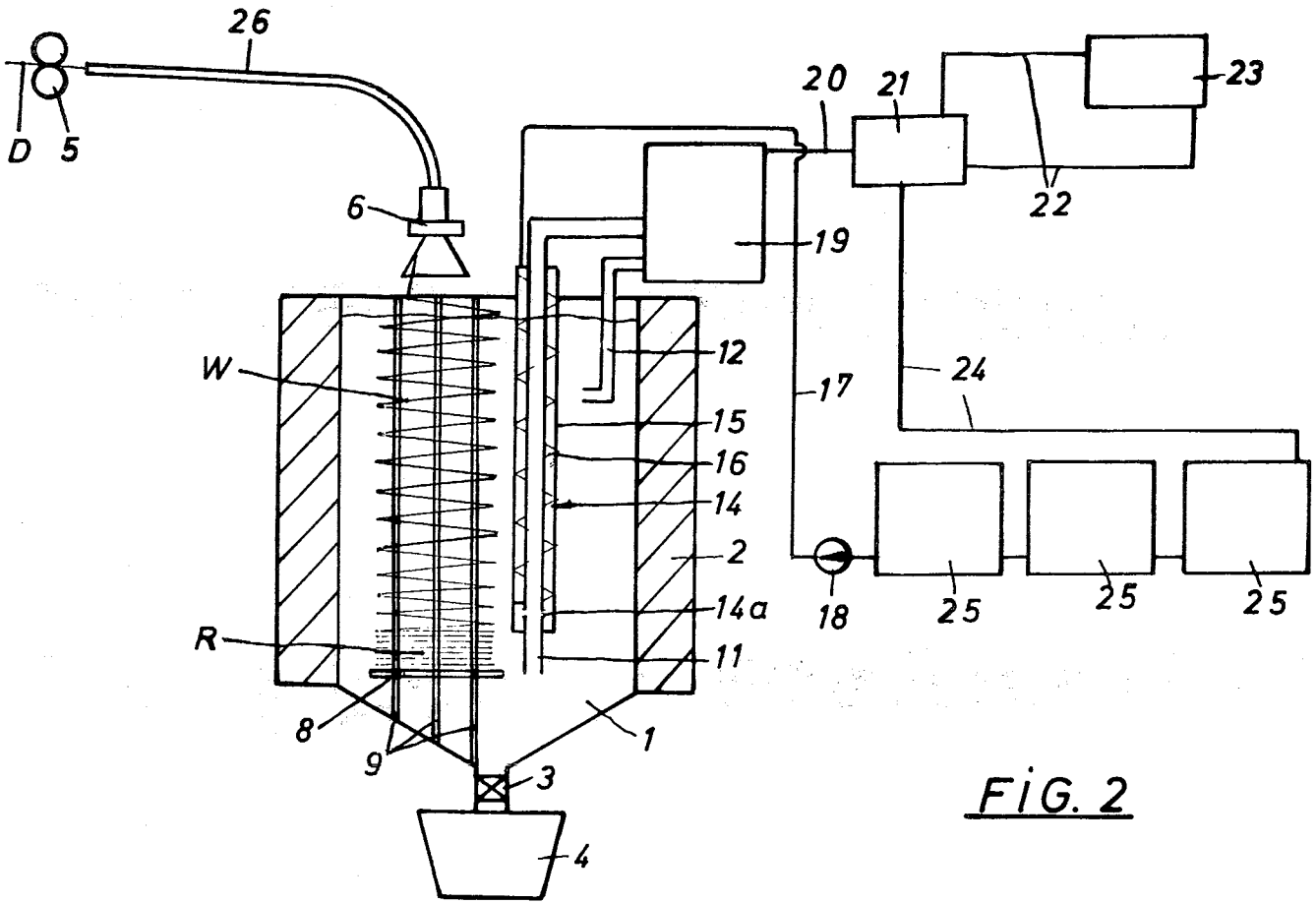
FIG. 2 is a similar diagrammatic partly elevational and partly sectional view of a second apparatus.

The apparatus of FIG. 2 also comprises a vessel 1 with a heating unit 2 and a gate 3, a receptacle 4 for scale and/or other impurities, a coiling or winding device 6 which receives a hot steel rod D from the last pass 5 of a rod mill, and guide means including upright rod-like members 9 supporting a platform 8 for the bundle R. In the space between the last pass 5 and the coiling device 6, the rod D advances through a suitably bent tubular shield 26 wherein the rod is contacted by an inert gas, e.g., nitrogen.

The pump 10 of FIG. 1 is replaced with a so-called mammoth pump 14 which is mounted in the interior of the vessel 1 adjacent to the rod-like guide members 9 and serves to recirculate the liquid through a separator 19. The pump 14 is operated with water and steam. The suction pipe 11 of FIG. 2 can be said to constitute a component part of the pump 14; this pump further comprises a cylindrical jacket 15 which is preferably coaxial with and surrounds the pipe 11 in the interior of the vessel 1. The lower end portion of the jacket 15 sealingly surrounds the pipe 11 close to the lower portion of the vessel 1, and the pipe 11 has one or more apertures 14*a* (which may constitute an annular gap) located close to the lower end of the jacket 15. The annular space between the external surface of the pipe 11 and the internal surface of the jacket 15 contains a screw thread 16 which defines a helical path for water and/or steam which is supplied into the uppermost portion of the jacket by a conduit 17 connected to the outlet of a feed pump 18. The latter draws water from the leftmost tank 25 of a series of three rinsing tanks 25. The stream of water which enters the upper end of the jacket 15 is heated and converted (at least in part) into steam during travel along the helical path defined by the screw thread 16. The steam enters the pipe 11 by way of the apertures 14*a* and and rises in the pipe 11 to thereby draw liquid from the lower portion of the vessel 1. The mixture of steam and liquid enters the separator 19 which is connected with a steam evacuating conduit 20 discharging into a condenser 21. The separator 19 returns liquid into the vessel 1 by way of a pipe 12 which discharges into the upper zone of the body of liquid in the vessel. That portion of the stream of water entering the jacket 15 via conduit 17 which is not converted into steam during travel along the helical path defined by the screw thread 16 is invariably converted into steam upon entry into the pipe 11, i.e., as soon as it comes into direct contact with hot liquid which fills the vessel 1.

The conversion of water into steam (partly in the jacket 15 and partly in the pipe 11) results in withdrawal of heat from the liquid in the vessel 1. The amount of heat which is being withdrawn from the liquid as a result of conversion of water into steam is very high so that the liquid in the vessel 1 is subjected to a pronounced cooling action which suffices to insure withdrawal of heat energy supplied by successive coils W.

The condenser 21 effects condensation of steam supplied by the conduit 20, and the thus obtained condensate flows into the rightmost rinsing tank 25 by way of a conduit 24. The means for cooling steam in the condenser 21 comprises a heat exchanger including a system of coolant conveying pipes 22 defining an endless path a first portion of which extends through the condenser 21 and a second portion of which extends through a suitable cooling device 23 wherein the coolant exchanges heat with water or another suitable fluid medium.

The condensate which enters the rightmost rinsing tank 25 is cascaded into the next and thereupon into the leftmost rinsing tank 25 of FIG. 2. The cascading condensate can be used to rinse successive bundles R upon removal of such bundles from the vessel 1. As mentioned above, the last tank 25 supplies water to the feed pump 18 which forces such water to flow into the jacket 15 via conduit 17. The manner in which the contents of the tanks 25 are used to rinse bundles R is preferably such that the transport of bundles R between successive rinsing stages is preferably counter to the flow of condensate toward the feed pump 18. Such rinsing action results in removal of salt which adheres to the convolutions of the bundles R. All of the salt which is removed by condensate flowing in or between the rinsing tanks 25 is returned into the vessel 1 via pump 18, conduit 17, separator 19 and pipe 12. This is desirable and advantageous because the apparatus need not be provided with a regenerator for replenishment of the quantity of salt in the vessel 1 and also for ecological reasons.

The manner in which the coiling or winding device 6 forms and delivers successive coils W into the body of liquid in the vessel 1 of FIG. 2 is the same as described in connection with FIG. 1. Thus, the coils W do not touch each other during a substantial part of their movement toward the platform 8. The minimum height or depth of the body of liquid in the vessel 1 equals the maximum height of the bundle R plus a distance which is needed to insure that the coils W undergo desirable structural changes while remaining out of contact with each other. The just mentioned distance must be sufficient to insure that the temperature of each coil W (i.e., also the last coil W of a rod D) descending toward the platform 8 is reduced to a preselected value before such coil comes to rest on the uppermost convolution of the bundle R. The speed at which the coils W descend in the vessel 1 depends on specific weight of the material of the rod D, on specific weight of liquid in the vessel 1, on the viscosity (i.e., temperature) of such liquid, and on the speed at which the rod mill is operated. The temperature of each loose coil W is reduced to that which is desirable to effect optimal structural changes before the lowermost loose coil comes into contact with the uppermost coil of the bundle R growing on the platform 8.

The important factors which determine the structure of convolutions in the bundle R include the temperature of the bath in the vessel 1 and the length of intervals during which the body of liquid in the vessel influences loose coils W descending from the winding device 6 toward the growing bundle on the platform 8. The length of such intervals determines the speed at which the structural changes in the material of loose coils occur. As mentioned above, the length of just mentioned intervals depends on the speed of downward movement of loose coils and on the distance between the platform 8 or the uppermost convolution of a growing bundle R on the platform and the level of the upper surface of liquid bath in the vessel 1.

It is highly desirable to insure that each and every layer or zone of the liquid bath in the vessel 1 should be maintained at identical or practically identical temperature. Localized overheating could result in thermal decomposition of the liquid bath. The likelihood of localized overheating is especially pronounced immediately below the winding device 6 where the coils W descend into the bath. Therefore, the outlet of the return pipe 12 is preferably placed at or close to the locus of entry of successive loose coils W. Thermally induced decomposition of liquid is undesirable for a number of reasons, i.e., the liquid must be evacuated and replaced with satisfactory liquid, and the constituents of decomposed liquid are likely to exert an undesirable influence on the material of the coils. The recirculation of liquid which is confined in the vessel is preferably continuous, at least during introduction of loose coils W, i.e., prior to accumulation of a complete bundle R on the platform 8.

The action of means which conditions the liquid (such conditioning means includes the parts 2 and 10–13 shown in FIG. 1 and analogous parts shown in FIG. 2) is preferably adjustable so as to allow for regulation of liquid temperature in response to changing speed of lengthwise movement of rods D from the last pass of the rod mill toward the winding device 6. As a rule, the conditioning means will invariably withdraw heat from the liquid as long as the winding device 6 supplies coils W. The heating of liquid which is confined in the vessel 1 will take place when the conversion of a rod D into a bundle R is completed, and the purpose of such heating is to insure that the temperature of liquid does not drop below the minimum permissible temperature, i.e., that the bath is always ready to receive the coils of a fresh rod D.

The mammoth or gas-lift pump 14 of FIG. 2 exhibits the advantage that it need not have any moving parts. Therefore, the wear upon its components is practically nil (save for eventual corrosive effects of liquids inside and without the pipe 11 and jacket 15). It has been found that the utilization of a mammoth pump contributes significantly to economic operation of the conditioning means. Moreover, the mammoth pump constitutes an extremely simple but efficient and inexpensive means for returning recovered salts from the rinsing station or stations into the liquid bath in the vessel 1. Such recovery of salts which are removed from the vessel when a complete bundle R is lifted off the platform 8 also contributes to economy of operation and insures that the salts cannot contaminate the surrounding area.

The shield 26 of FIG. 2 preferably extends all the way from the last pass 5 to the winding device 6, and the inert gas which is caused to pass therethrough preferably flows in the direction of lengthwise movement of the rod. Such mounting of the shield insures that the contact between the rod D and the surrounding atmosphere is reduced to a minimum which, in turn, greatly reduces oxidation and the resulting formation of scale. The construction of means for conveying inert gas through the shield 26 forms no part of the present invention.

The apparatus of FIG. 2 exhibits the additional advantage that the temperature of liquid in the vessel 1 can be regulated by the rapidly reacting induction-type electric heater 2 as well as by varying the quantity of water which is being fed into the upper portion of the jacket 15. The device 2 will be turned on if the temperature of liquid in the vessel 1 is too low; this can take place simultaneously with a reduction in the rate of admission of water into the jacket 15. If the temperature of liquid is too high, the device 2 is turned off or its heating action reduced simultaneously with admission of larger quantities of water into the jacket 15 per unit of time. Such dual regulation of liquid temperature in the vessel 1 insures that the temperature can be maintained within a very narrow optimum range independently of the amounts of heat which are supplied to liquid by successive coils W.

Without further analysis, the foregoing will so fully reveal the gist of the present invention that others can, by applying current knowledge, readily adapt it for various applications without omitting features which fairly constitute essential characteristics of the generic and specific aspects of our contribution of the art and, therefore, such adaptations should and are intended to be comprehended within the meaning and range of equivalence of the claims.

What is claimed as new and desired to be protected by Letters Patent is set forth in the appended claims.

1. In a manufacturing method wherein metallic rod issues hot from a mill, the improvement comprising the steps of: heating a salt bath above a lower predetermined temperature below that of said rod; withdrawing liquid from the bottom of said bath, cooling the withdrawn liquid to below a higher predetermined temperature below that of said rod and above said lower temperature, and reintroducing the cooled and withdrawn liquid into the top of said bath; forming said rod substantially directly as it issues from said mill and before substantial cooling of said rod into a succession of turns; lowering said turns as they are formed by gravity into said bath one after another through the bath while maintaining said turns out of contact with each other as they are lowered for a period of time sufficient to effect a predetermined structural change in the metal of said turns as a result of differences between the temperatures of said turns and of said bath; and accumulating said turns after lowering same into said bath into a bundle with said turns lying on one another.

2. The method defined in claim 1 wherein said liquid is withdrawn from said bath by passing a pump liquid having a boiling point below said temperature in heat-exchange with said bath to vaporize said pump liquid and introducing the vaporized pump liquid into said bath below a downwardly open conduit, whereby said vaporized pump liquid rises in said conduit and lifts the liquid of said bath in said conduit.

3. A method as defined in claim 1, further comprising the step of contacting said rod with an inert gas prior to said winding step.

4. A method as defined in claim 1, wherein said cooling step comprises exchanging heat between said bath and a body of water, and further comprising the steps of removing said bundle from said bath and rinsing the thus removed bundle with said water to remove salt from said turns.

5. A method as defined in claim 4, further comprising the step of reintroducing the thus removed salt into said bath.

6. In a plant wherein metallic rod issues hot from a mill, a treatment system comprising: a vessel containing a salt bath; means for heating said bath above a lower predetermined temperature below that of said rod; means for withdrawing liquid from the bottom of said bath, cooling the withdrawn liquid to below a higher predetermined temperature below that of said rod and above said lower temperature, and returning the cooled and withdrawn liquid to the top of said bath; means above said vessel for forming said rod substantially directly as it issues from said mill and before substantially cooling of said rod into a succession of turns; means below the turn-forming means for lowering said turns as they are formed by gravity into said bath one after another while maintaining said turns out of contact with one another as they are lowered for a period of time sufficient to effect a predetermined structural change in the metal of said turns as a result of differences between the temperatures of said turns and of said bath; and support means at the bottom of said bath for accumulating said turns after lowering of same into said bath into a bundle with said turns lying on one another.

7. Apparatus as defined in claim 6, wherein the distance between said support means and the upper surface of said bath is such that each coil of a rod remains out of contact with the neighboring coils for a predetermined minimum period of time during travel toward the growing bundle on said support means.

8. Apparatus as defined in claim 6, wherein said heating means comprises an induction heater which surrounds at least a portion of the liquid bath in said vessel.

9. Apparatus as defined in claim 6, wherein said withdrawing means comprises a first pipe having an inlet located in the lower zone of said bath and said returning means comprises a second pipe having an outlet in the upper zone of said bath.

10. Apparatus as defined in claim 6, wherein said cooling means comprises at least one heat exchanger.

11. Apparatus as defined in claim 10, wherein said withdrawing means comprises a pump located outside of said vessel and said heat exchanger is also located outside of said vessel.

12. Apparatus as defined in claim 6, wherein said withdrawing means comprises mammoth pump.

13. Apparatus as defined in claim 12, wherein said mammoth pump comprises a suction pipe having an inlet in communication with said bath, a jacket surrounding said pipe and communicating therewith in the region of said inlet, and means for feeding water into said jacket whereby such water is converted into steam by the liquid which surrounds and heats said jacket with resultant withdrawal of heat from the liquid, the thus obtained steam entering into and rising in said pipe to draw said steam of liquid into and upwardly through said pipe, said returning means comprising means for separating steam from said liquid stream and a second pipe for returning said liquid stream from said separating means into said bath.

14. Apparatus as defined in claim 13, further comprising means for condensing steam in said separating means and means for supplying the thus obtained condensate to said feeding means.

15. Apparatus as defined in claim 14, further comprising at least one tank in said condensate supplying means, said tank having means for rinsing bundles of coils upon removal of bundles from said bath so that the condensate removes remnants of liquid from the coils of such bundles.

16. Apparatus as defined in claim 14, further comprising a series of tanks in said condensate supplying means, said tanks having means for rinsing bundles with condensate upon removal of bundles from said bath to wash remnants of liquid from the coils of such bundles.

17. Apparatus as defined in claim 16, wherein each bundle is placed into each of said tanks in such sequence that it is first rinsed in the tank nearest to said feeding means and last in the tank nearest to said condensing means.

* * * * *